United States Patent [19]

Brodersen

[11] 4,183,160

[45] Jan. 15, 1980

[54] EVACUATED MOUNT FOR DISPLAY OBJECTS

[75] Inventor: Hardy G. Brodersen, Birmingham, Mich.

[73] Assignees: Brokenspar Inc., Birmingham, Mich.; George Vihos, New York, N.Y.

[21] Appl. No.: 881,540

[22] Filed: Feb. 27, 1978

[51] Int. Cl.[2] ..... G09F 1/12

[52] U.S. Cl. ..... 40/152

[58] Field of Search ..... 40/154, 10 D, 152

[56] References Cited

U.S. PATENT DOCUMENTS

| | | | |
|---|---|---|---|
| 764,273 | 7/1904 | Denton et al. | 40/152 X |
| 3,284,939 | 11/1966 | Perrot | 40/152 |
| 4,114,300 | 9/1978 | Holson | 40/152 |

FOREIGN PATENT DOCUMENTS

| | | | |
|---|---|---|---|
| 660593 | 2/1929 | France | 40/152 |
| 6556 | of 1892 | United Kingdom | 40/152 |
| 320736 | 10/1929 | United Kingdom | 40/152 |

*Primary Examiner*—John F. Pitrelli

*Assistant Examiner*—Wenceslao J. Contreras

*Attorney, Agent, or Firm*—Cullen, Sloman, Cantor, Grauer, Scott & Rutherford

[57] ABSTRACT

A mount for display objects including drawings, paintings, thin sheets or other large thin sheets comprising a pair of opposed rectangular flexible plastic sheets arranged face to face and adapted to receive the display object therebetween, at least one of said sheets being transparent. Said sheets have continuous opposed peripheral inner wall portions with peripheral recesses formed in said wall portions defining a peripheral cavity. A sealant fills said cavity throughout 360° for securing and sealing together said sheets around their periphery. The space between said sheets is evacuated with the display object operatively, snugly and protectively held and sealed between said sheets. A continuous channel extends around and receives and encloses margins of said sheets overlying said sealant. Additional sealant substantially fills said channel and is interposed between said channel and peripheral outer sides and edges of said sheets.

11 Claims, 3 Drawing Figures

FIG. 1
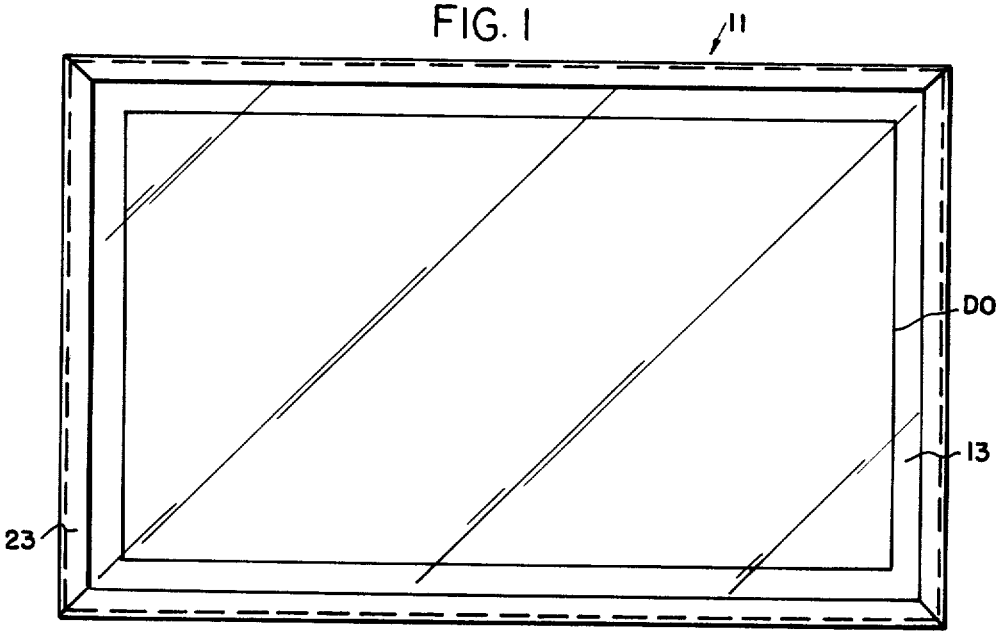
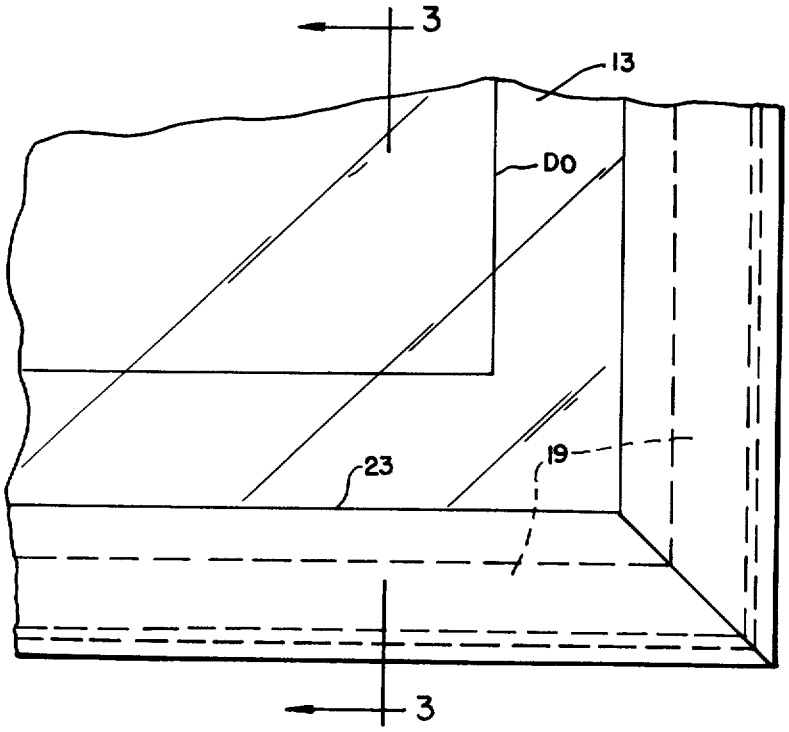
FIG. 2
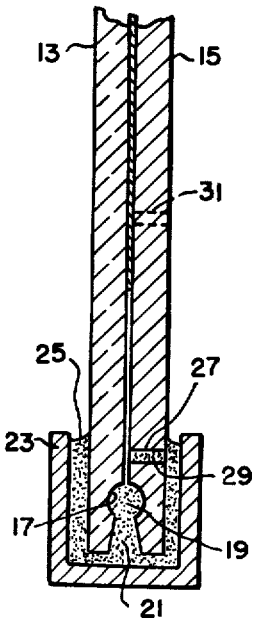
FIG. 3

EVACUATED MOUNT FOR DISPLAY OBJECTS

BACKGROUND OF THE INVENTION

Conventional mounting of a thin flexible display object such as a painting or drawing or large sheet has been accomplished heretofore interposing such display object between a pair of sheets, one of which is transparent, and in some manner securing the sheets together.

Unless the display object is adhered or otherwise affixed to one or both of the covering sheets, it will lie loose between the sheets, and curvatures in the outer surfaces of the display object will be apparent.

It is known to adhere a sheet to a backing with a layer of adhesive by temporarily positioning the sheet and backing within a vacuum chamber temporarily removing the air therefrom and applying heat for bonding the sheet to the backing after which the sheet and backing have been removed from such chamber. Such a method of securing a flexible sheet to a stiff backing is shown in U.S. Pat. No. 2,620,289.

It is known to hermetically seal a pair of glass plates together by providing a sealant material peripherally around a pair of opposed spaced glass plates to provide a hermetically sealed storage chamber. An illustration of this is shown in U.S. Pat. No. 3,733,237.

It is known in the photographic industry to provide over a glass frame a flexible rubber blanket peripherally secured thereto wherein a negative and a sensitized sheet be interposed in contact relationship by evacuating the space between said glass and blanket for a momentary photographic exposure after which the vacuum is eliminated and the exposed sheet removed. Examples of this are found in U.S. Pat. Nos. 3,738,890 and 3,951,724. Such apparatus is employed for photographic contact printing.

SUMMARY OF THE INVENTION

It is an object of the present invention to provide a mount for display objects which are large, thin and flexible and wherein the object is interposed between a pair of opposed sheets which are brought together face to face and wherein one of the sheets is transparent and the sheets are peripherally sealed and secured together. The space between the sheets is evacuated whereby the opposing sheets operatively and snugly and protectively hold the display object therebetween, and sealed from the outside atmosphere.

It is another object to provide a mount for such display objects, by interposing such object between a pair of opposed supporting sheets, one of which is transparent and wherein inner peripheral edge portions of the sheets have been routed or otherwise recessed to define a peripheral recess receiving a sealant material or peripherally securing and sealing together corresponding edge portions of said sheets, the space between said sheets being evacuated whereby the display object is tightly held in a single plane between said sheets.

It is a further object to provide a channel frame which receives and extends around peripheral edge portions of the assembled sheets and wherein a sealant fills the channel and is interposed between the channel and the outer surfaces and edges of said sheets.

These and other objects will be seen from the following specification and claims in conjunction with the appended drawing.

DRAWING

FIG. 1 is a front elevational view of the present mount for display objects.

FIG. 2 is a similar view on an enlarged scale of a corner portion of the mount for display objects of FIG. 1.

FIG. 3 is a fragmentary section taken in the direction of arrow 3—3 of FIG. 2.

It will be understood that the above drawing illustrates merely a preferred embodiment of the invention, and the other embodiments are contemplated within the scope of the claims hereinafter set forth.

DETAILED DESCRIPTION OF THE INVENTION

The present invention is directed to the vacuum mounting of display sheets such as for drawings, large drawings, paintings, thin sheets, rare documents, old manuscripts, historic flags, tapestries, artifacts or like large thin sheets. Said sheets may be of the order of 7 to 9 feet by 10 to 12 feet.

The difficulty heretofore in mounting such display objects between a pair of glass plates or other sheets is that the sheets are only anchored at their perimeter and sealed. In accordance with the present invention, the space between the sheets holding the display object is evacuated thus flattening out the display object by a uniform pressure over the entire area of the supporting sheets. Accordingly, the present mount for the display objects holds and flattens the material for viewing and at the same time seals it from contamination by atmosphere (oxidation, chemical contamination, unfavorable changes in humidity). Thus there is incorporated in the present invention mechanical pressing by atmosphere to hold the fragile or other display object perfectly flat throughout all surfaces thereof by continuous and uniform force.

Referring to the present drawing, there is shown for illustration the present vacuum mount for display objects generally indicated at 11 as including front rectangular sheet 13 and corresponding back rectangular sheet 15. At least one or both sheets may be constructed of plastic such as an acrylic plastic or a plastic known as Plexiglass, and at least one of the sheets is transparent as, for example, the front sheet 13, FIG. 3.

The display object generally indicated at DO in FIGS. 1, 2 and 3 is usually in the form of a large sheet of material which may be a drawing or a painting or other large thin sheet, a rare document, a manuscript, a flag, a tapestry or an artifact to be held flat, sealed and protected.

In the present vacuum mount for display objects, said display object DO is centrally interposed between the pair of registering opposed front and back sheets 13 and 15. Along and continuously around inner peripheral wall portions of both sheets there is routed or formed irregular recesses 17 which extend throughout 360°. These recesses extend to the outer edges of the respective sheets, as shown in FIG. 3, to define the channel or cavity 19.

A suitable sealant 21, preferably a silicone rubber sealant, for illustration, fills the recess 17 peripherally throughout 360° for peripherally sealing the outer edge portions of said sheets with the display object therebetween as in FIG. 3.

Front sheet 13 is of a clear, transparent material.

The respective sheets 13 and 15 are trimmed to the same size and are each routed on their inner face around the peripheral portions thereof to define the continuous pocket or cavity 19 which is filled with silicone rubber sealant.

A decorative support frame 23 preferably of aluminum extrusion, for illustration, opens inwardly and loosely extends around and encloses all peripheral edges of the front and back sheets 13 and 15.

An additional sealant 25 such as the present silicone rubber sealant is projected into said channel between the inner walls of said channel on the three sides thereof and the corresponding adjacent surfaces of the sheets 13 and 15 including their outer peripheral registering edges as best shown in FIG. 3.

Prior to the assembly of the channel frame 23 around the sheets 13 and 15 the bore 27 is formed through one of the sheets as for example the back sheet 15 extending to its interior surface. The source of vacuum is applied to the hole or bore 27 in order to evacuate all of the air between the sheets 13 and 15 after which the said bore is filled by the sealant 29 such as the present silicone rubber sealant.

After the air has been evacuated using a suitable vacuum pump or other source of vacuum, the small access hole or bore is sealed for maintaining the vacuum between the sheets.

Should the vacuum need to be re-introduced, a similar hole or bore may be made as at 31 FIG. 3 and the procedure repeated.

The present frame which is aluminum for illustration is one of a number of decorative options and further serves to hide the peripheral sealant 21 and to provide a means of attachment for hanging the picture or other display object.

The above described recesses 17 routed into the inner peripheral surface portions of the sheets, are irregular in shape to produce a corresponding cross-sectional shape to the sealant 21 tending to interlockingly retain the sealant as assembled in FIG. 3.

Said sealant not only holds the Plexiglass or other panels together but seals the interior of the space between the panels or sheets 13 and 15.

The present vacuum mount for display objects is particularly applicable for extraordinarily large drawings and provides a means for holding them perfectly flat for viewing. The present vacuum mount display is particularly adaptable for the storage and preservation in holding flat on display precious or fragile documents or other materials in museum collections.

Having described my invention, reference should now be had to the following claims:

I claim:

1. A mount for thin flexible display objects including drawings, large drawings, paintings, thin sheets, rare documents, old manuscripts, historic flags, tapestries, artifacts, or other large thin sheets; comprising a pair of opposed rectangular flexible plastic sheets arranged face to face adapted to receive a display object therebetween; at least one of said sheets being transparent; said sheets having continuous opposed peripheral inner wall portions; said wall portions having opposed peripheral recesses therein, defining a peripheral cavity; and a sealant filling said cavity throughout 360° for securing and sealing together said peripheral wall portions; the space between said sheets being evacuated, with said display object operatively, snugly and protectively held and sealed in a single plane between said sheets.

2. In the display object mount of claim 1, there being a bore through one of said sheets to tis interior inwardly of said sealant, adapted for withdrawing any air from between said sheets; and a sealant filling and sealing off said bore.

3. In the mount for display objects of claim 1, an inwardly opening channel frame loosely extending completely around the margins of said sheets overlying said sealant; and a sealant substantially filling said channel interposed between said channel and the peripheral outer sides and edges of said sheets.

4. In the mount for display objects of claim 2, an inwardly opening channel frame loosely extending completely around the margins of said sheets overlying said sealant; and a sealant substantially filling said channel interposed between said channel and the peripheral outer sides and edges of said sheets, said sealant covering said bore.

5. In the mount of claim 1, said recesses extending to the edges of said sheets.

6. In the mount of claim 1, said recesses being of irregular shape for retainingly interposing the peripheral sealant therebetween.

7. In the mount of claim 1, the other of said sheets being transparent.

8. In the mount of claim 1, said sealant being of silicone rubber.

9. In the mount of claim 1, said sheets being Plexiglass.

10. In the mount of claim 3, said channel frame being of aluminum.

11. In the mount for display objects of claim 1, said display object being in size on the order of 7 to 10 feet by 9 to 12 feet, being held flat between said sheets.

* * * * *